United States Patent [19]

Arnold et al.

[11] 4,140,552

[45] Feb. 20, 1979

[54] METHOD OF TREATING ALUMINUM-KILLED AND LOW ALLOY STEEL STRIP AND SHEET SURFACES, IN SULFUR-BEARING ATMOSPHERE, FOR METALLIC COATING

[75] Inventors: Jerry L. Arnold, Franklin; Frank C. Dunbar, Monroe, both of Ohio

[73] Assignee: Armco Steel Corporation, Middletown, Ohio

[21] Appl. No.: 753,634

[22] Filed: Dec. 23, 1976

[51] Int. Cl.[2] ..... C23C 11/08

[52] U.S. Cl. ..... 148/6.35; 148/16; 427/248 E; 427/320; 427/321

[58] Field of Search ..... 427/319, 320, 321, 55, 427/160, 248 E; 148/6.35, 16; 266/257

[56] References Cited

U.S. PATENT DOCUMENTS

| | | | |
|---|---|---|---|
| 1,141,770 | 6/1915 | Carnahan | 148/6.35 |
| 1,672,180 | 6/1928 | Smith | 148/6.35 |
| 2,110,893 | 3/1938 | Sendzimir | 427/229 |
| 2,562,770 | 7/1951 | Carter, Jr. | 427/160 X |
| 3,115,421 | 12/1963 | Seymour | 427/55 |
| 3,925,579 | 12/1975 | Flinchum et al. | 427/320 |

FOREIGN PATENT DOCUMENTS

| | | | |
|---|---|---|---|
| 701685 | 1953 | United Kingdom | 148/6.35 |

*Primary Examiner*—Ronald H. Smith
*Assistant Examiner*—Evan K. Lawrence
*Attorney, Agent, or Firm*—Melville, Strasser, Foster & Hoffman

[57] ABSTRACT

A method of surface treatment of aluminum-killed and low alloy steel strip and sheet for fluxless hot dip metallic coating which comprises heating the steel in a furnace atmosphere containing the hot gaseous combustion products of air with a sulfur bearing gaseous fuel including 5 to 1600 grains of sulfur per 100 cubic feet of fuel wherein the atmosphere includes sulfur compounds and from about 6% free oxygen to about 7% by volume excess combustibles whereby to form a sulfur and oxygen rich film on the steel surfaces, passing the steel into a further heating section wherein it is brought to a maximum temperature of about 593° to about 927° C. in a reducing atmosphere containing at least 10% hydrogen by volume, passing the steel into a cooling section having an atmosphere containing at least 10% hydrogen and the balance nitrogen whereby to reduce the sulfur and oxygen rich film to a metallic iron surface, and cooling the steel approximately to the temperature of the molten coating metal bath. Coke oven gas may be used as the fuel for the furnace.

10 Claims, 1 Drawing Figure

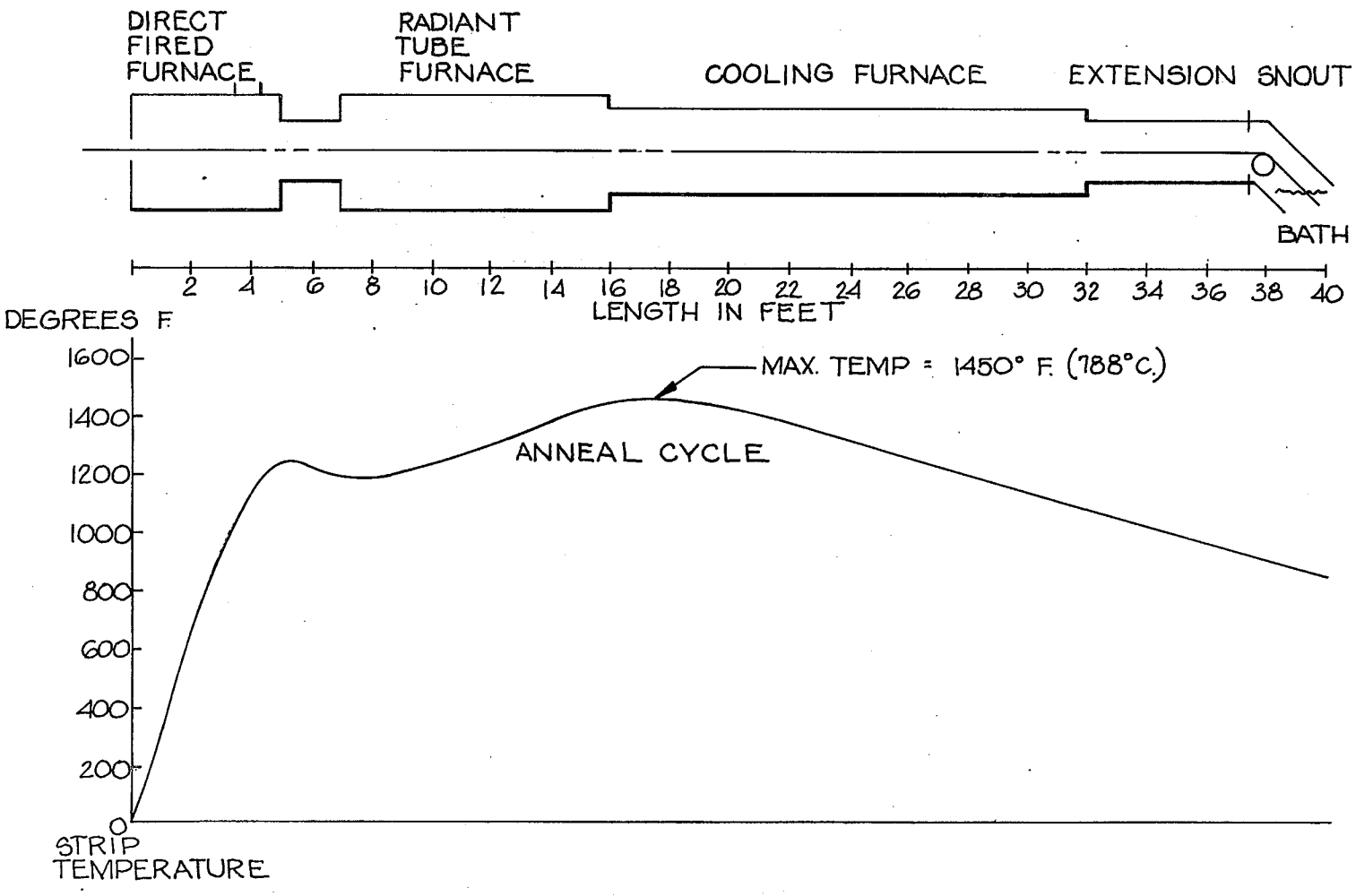
DIRECT FIRED FURNACE
RADIANT TUBE FURNACE
COOLING FURNACE
EXTENSION SNOUT
BATH
2 4 6 8 10 12 14 16 18 20 22 24 26 28 30 32 34 36 38 40
LENGTH IN FEET
MAX. TEMP = 1450° F. (788°C.)
ANNEAL CYCLE
DEGREES F.
1600 1400 1200 1000 800 600 400 200 0
STRIP TEMPERATURE

METHOD OF TREATING ALUMINUM-KILLED AND LOW ALLOY STEEL STRIP AND SHEET SURFACES, IN SULFUR-BEARING ATMOSPHERE, FOR METALLIC COATING

BACKGROUND OF THE INVENTION (1) Field of the Invention

This invention relates to a process of hot dip metallic coating of aluminum killed and low alloy steel strip and sheet material and more particularly to the preliminary treatment of the strip and sheet surfaces in a sulfur-containing atmosphere whereby to enhance the wettability thereof by molten coating metals such as zinc, zinc alloys, aluminum, aluminum alloys, and terne. Low alloy steels which may be treated by the process of the invention contain up to about 3% aluminum, up to about 1% titanium, up to about 2% silicon, or up to about 5% chromium, and mixtures thereof, with the remainder of the composition typical of carbon steel, as defined by Steel Products Manual, Carbon Sheet Steel, page 7 (May 1970), published by American Iron and Steel Institute. Aluminum killed steels include typical carbon steel as defined above containing from about 0.03% to about 0.06% acid-soluble aluminum.

(2) Description of the Prior Art

In the fluxless, hot dip metallic coating of steel strip and sheet, it is necessary to subject the strip and sheet surfaces to a preliminary treatment which provides a clean surface free of oxide scale which is readily wettable by the molten coating metal and to which the coating metal will adhere after solidification thereof. One of the principal types of anneal-in-line preliminary treatment, to which the present invention is applicable, is the so-called Selas process, a description of which is contained in U.S. Pat. No. 3,320,085, issued May 16, 1967 to C. A. Turner, Jr.

The Turner patent discloses a method of treating carbon steel strip and sheet material which comprises passing the material through a furnace heated to a temperature of at least about 2200° F. (1205° C.) by direct combustion of fuel and air therein, the furnace containing an atmosphere of gaseous products of combustion having no free oxygen and at least about 3% excess combustibles in the form of carbon monoxide and hydrogen, the residence time of the material being sufficient to cause it to reach a temperature of about 800° to 1300° F. (427° to 705° C.), while maintaining bright steel surfaces completely free from oxidation, withdrawing the material from the furnace while still surrounded by gaseous products of combustion, introducing the material directly into a reducing section having a hydrogen and nitrogen atmosphere, in which the material may be further heated from 800° to 1700° F. (427° to 927° C.) and/or cooled to approximately molten coating bath temperature, and then leading the material beneath the surface of the bath while surrounded by the hydrogen-nitrogen protective atmosphere.

U.S. Pat. No. 3,925,579 issued Dec. 9, 1975, to C. Flinchum et al, discloses a method of fluxless hot dip metallic coating of low alloy steel strip and sheet stock (as hereinabove defined) in which one or more alloying elements is present in an amount greater than the critical content thereof as hereinafter defined, wherein the surfaces of the stock are prepared for coating by heating to a temperature of about 593° to about 913° C. in an atmosphere oxidizing to iron whereby to produce a surface layer of iron oxide containing a uniform dispersion or solid solution of oxides of the alloying elements, followed by further heat treatment under conditions reducing to iron oxide. The method of this patent is applicable either to the Selas method, or to the so-called Sendzimir method of preliminary treatment (described in U.S. Pat. Nos. 2,110,893 and 2,197,622) which need not be described herein since the present invention is not practicable with the Sendzimir method. The method of the Flinchum et al patent is also applicable to aluminum killed steels which contain sufficient acid-soluble aluminum to cause poor adherence of the solidified coating metal when subjected to conventional preliminary treatment by the method disclosed in the Turner patent.

In all prior art processes for preliminary treatment of steel strip and sheet surfaces which are exposed to atmospheres of direct fired furnaces, including the methods of the above-mentioned Turner and Flinchum et al patents, it has been considered that the presence of even small amounts of sulfur, in the atmosphere would be highly deleterious. Accordingly, substantially sulfur-free fuel such as natural gas has been prescribed for use in such furnaces. However, natural gas shortages have made it necessary to consider alternative sources of fuel. In a steel mill having coke ovens, the use of coke oven gas as a fuel source would be an obvious choice except for the fact that raw coke oven gas ordinarily contains about 300 to 500 grains of sulfur per 100 cubic feet of gas, the sulfur being present primarily as hydrogen sulfide with a small amount of organic sulfur compounds. Although the gas can be easily scrubbed to a sulfur level of about 75 to 100 grains per 100 cubic feet, and with modern and more sophisticated equipment can be cleaned to a level of about 25 to 40 grains per 100 cubic feet, it has nevertheless been generally considered that the Selas-type preliminary treatment methods for in-line hot dip metallic coating could not tolerate even the lower sulfur levels of scrubbed coke oven gas. Accordingly, it was believed that curtailment of natural gas supply would force the shut-down of coating lines equipped with direct fired furnaces for preliminary treatment of steel strip and sheet material.

SUMMARY OF THE INVENTION

The present invention constitutes a discovery that sulfur-bearing coke oven gas can be used as a fuel in direct fired furnaces for preliminary treatment of the surfaces of aluminum-killed and low alloy steel strip and sheet material, without deleterious effects. Surprisingly, it has been found that a film rich in sulfur and oxygen, which is thin and uniform, forms readily on the strip and sheet material surfaces, and that this film can be easily reduced in a subsequent reducing section to produce a fresh ferrous surface which is readily wetted by liquid coating metal, with resultant excellent adherence after solidification of the coating. This sulfur and oxygen rich film is both easier to form and easier to reduce than the iron oxide film (containing a uniform dispersion or solution of oxides of alloying elements) formed in the process of the Flinchum et al U.S. Pat. No. 3,925,570. Accordingly, considerable latitude in temperature, furnace atmospheres and steel compositions is permissible in the practice of this invention. Moreover, it has been found that the sulfur content of the furnace fuel can vary over a wide range without adverse effect on coating metal adherence.

Accordingly, the present invention provides a method of preparing the surfaces of aluminum-killed and low alloy strip and sheet material for fluxless hot dip metallic coating, which comprises passing the material through a furnace heated by direct combustion therein of air with gaseous fuel containing sulfur compounds ranging from about 5 to about 1600 grains of sulfur per 100 cubic feet of fuel to produce an atmosphere of gaseous products of combustion including sulfur and from about 6% by volume free oxygen to about 7% by volume excess combustibles in the form of carbon monoxide and hydrogen, in which atmosphere the material is heated; to form a sulfur and oxygen rich film on the surfaces; passing the material into a further heating section wherein the material is brought to a maximum temperature of about 1100° to about 1700° F. (593° to 927° C.) in a reducing atmosphere containing at least about 10% hydrogen by volume; passing the material into a cooling section having an atmosphere containing at least 10% hydrogen by volume and the balance essentially nitrogen wherein the sulfur and oxygen rich film is reduced; and cooling the material approximately to the temperature of the molten coating metal bath.

BRIEF DESCRIPTION OF FIGURE

The FIGURE is a schematic illustration of a preliminary treatment line and temperature profile of a typical anneal cycle for aluminum-killed steel.

DESCRIPTION OF THE PREFERRED EMBODIMENT

Exemplary coating metals include zinc, zinc alloys aluminum, aluminum alloys and terne. The coating process may be any of the conventional continuous operations currently used.

Although not believed to be critical, the direct fired furnace section (or preheater) may be maintained at about 2200° F. (1205° C.) or higher, and the strip and sheet material exiting this section may be at a maximum temperature of about 800° to about 1300° F. (427° to about 705° C.). In the further heating section the material is preferably brought to a maximum temperature of about 1100° F. to about 1450° F. (593° to 788° C.), for the so-called anneal cycle. It is preferred to maintain a hydrogen content in the subsequent cooling section of at least about 20% by volume if the material is heated to a maximum strip temperature of about 1100° to about 1200° F. (about 593° to about 650° C.). The temperature of the further heating section may be maintained at about 1300° to about 2000° F. (705° to 1093° C.).

As is well known to those skilled in the art, the resident times in the various sections are variable and depend upon strip thickness, speed, heat absorptivity and related factors. The maximum temperature to which the material is brought in each section occurs at or near the exit therefrom, so that there is substantially no holding time at temperature, as is customary in continuous annealing practice.

In the Flinchum et al U.S. Pat. No. 3,925,579 an equation is disclosed from which it is possible to calculate the critical content of an alloying element (in a low alloy steel). When the critical content is exceeded, preliminary treatment by the conventional Selas method results in "external oxidation", i.e., the formation of a surface layer of alloy oxide which cannot be reduced under ordinary treatment conditions, and which thus will not be wetted by the molten coating metal. The aluminum content of an aluminum-killed steel is also governed by the same equation. The present invention is similarly applicable to aluminum-killed and low alloy steels wherein alloying elements more readily oxidizable than iron are present in amounts greater than the critical contents thereof as defined in the above Flinchum et al patent. It will also be recognized that the atmosphere in the cooling section must be controlled so as to be reducing to iron oxide (and hence, a fortiori, reducing to the sulfur and oxygen rich film), but it will not be reducing to the oxides of the alloying elements, which remain as a uniform dispersion in the iron matrix at the surface. Within the temperature range of about 1100° to about 1700° F. (593° to 927° C.), an atmosphere containing at least about 10% hydrogen, balance substantially nitrogen, and a dew point not higher than about +20° F., will readily meet these requirements.

The sulfur in coke oven gas is primarily hydrogen sulfide with small amounts of organic sulfides, the latter being unstable. Upon combustion with air, the hydrogen sulfide and organic sulfur compounds are believed to be converted to sulfur oxides in the gaseous combustion products of a direct fired furnace.

Full scale plant trials were conducted on a zinc coating line having a direct fired preheat furnace, a radiant tube furnace, and a cooling furnace as illustrated in FIG. 1. Although not shown, the cooling furnace comprised a jet cooling section and a slow cooling section. The direct fired preheat furnace was maintained at about 2300° F. (1260° C.), with strip temperature exiting therefrom ranging between 1000° and 1300° F. (538° and 705° C.). The amount of hydrogen sulfide was maintained at about 100 grains per 100 cubic feet. In order to ascertain the effects of sulfur introduction at various zones within the preheat furnace, natural gas was used as the fuel with arrangements for introduction of hydrogen sulfide into the natural gas feed at selected zones of the preheat furnace, including the final zone which is the most critical in proper strip preparation.

The first trial was designed to ascertain the effects of sulfur at various strip annealing temperatures, the effects of sulfur in the final zone of the furnace, and the effects of sulfur on aluminum-killed steel as compared to rimmed steel.

The initial tests resulted in the following empirical observations:

A definite visually detectable stain appeared on the surfaces of the strip upon the introduction of sulfur into the preheat furnace, the stain being a combined oxide and sulfide film.

Firing the final zone with natural gas containing no hydrogen sulfide did not completely remove the visible stain.

Aluminum-killed steel exhibited a much darker stain than rimmed steel.

While the strip was definitely stained at the exit of the preheat furnace, complete removal was obtained in the radiant tube furnace, so that good coating metal adherence was obtained. No discernable difference in adherence occurred between samples processed in the preheat furnace with natural gas containing no sulfur and samples processed in the preheat furance with natural gas containing about 100 grains of sulfur per 100 cubic feet.

Processing conditions for the initial tests are summarized in Table I. By way of explanation, Example 1 was a drawing quality rimmed steel of 0.043 inch thickness and 31⅛ inches width, while Example 2 was an aluminum-killed drawing quality steel of 0.055 inch thickness and 30 3/8 inches width. The aluminum content of Example 2 was 0.040%–0.043%.

The adherence test was the ball impact test. A rating of one indicates light crazing; a rating of two indicates heavy crazing; a rating of three indicates some detachment of the coating; and a rating of four indicates complete peeling of the coating. For prime applications a rating of one or two is considered satisfactory.

It will be apparent from the data of Table I that the presence of sulfur in the preheat furnace atmosphere was not detrimental, regardless of the zone in which it was introduced.

A second trial was conducted in order to determine whether possible adherence difficulties would occur with wider strip material, the reason for a more pronounced film on aluminum-killed steel than on rimmed steel at the same sulfur level, whether film was completely removed at the exit of the radiant tube (reducing) furnace, and the effect of lower temperature.

These further test results are summarized in Table II. These tests were conducted at a sulfur level of 150 grains per 100 cubic feet in the preheater furnace fuel. By way of further explanation, Example 3 was a "CQ" rimmed steel of 0.075 inch thickness and 60 inches width, while Example 4 was a drawing quality aluminum-killed steel of 0.038 inch thickness and 51 3/16 inches width containing 0.040%–0.043% aluminum.

It is evident from the data of Table II that satisfactory adherence was obtained at somewhat higher sulfur level, that the wide material presented no coating problems, that the "CQ" annealing temperature caused no adherence problems, and that the film was completely removed at the exit of the reducing furnace. These tests also confirmed that aluminum-killed steel developed a heavier film than rimmed steel, but no explanation for this can be given at the present time.

Further laboratory scale tests have resulted in the following empirical determinations:

Sulfur levels ranging between 60 and 1570 grains per 100 cubic feet resulted in a substantially constant surface discoloration at the exit of the direct fired furnace.

When operating under an anneal cycle where the strip temperature reached a maximum of 1450° F. (788° C.), it was found that the hydrogen content of the reducing furnace atmosphere was not critical, and that excellent coating adherence was obtained at hydrogen levels ranging between 15% and 40% by volume with sulfur levels of 100 to 200 grains per 100 cubic feet.

TABLE I

| Sample and Coil | Strip Temp. at Exit: Preheat Furnace ° F | Strip Temp. at Exit: Radiant Tube Furnace° F (25% $H_2$, 75% $N_2$ atmosphere) | Amount Sulfur Preheat (grains/100 $ft^3$) | Zone of Sulfur Addition | Adherence Test |
|---|---|---|---|---|---|
| Example 1 | | | | | |
| Coil 1 | 1115° | 1550° | 100 | Intermediate | 1/1 |
| Coil 2 | 1115° | 1550° | 100 | Final | 1/1 |
| Coil 3 | 1115° | 1550° | 100 | Final | 1/1 |
| Coil 4 | 1115° | 1550° | 0 | | 2/2 |
| Coil 5 | 1115° | 1550° | 0 | | 1/1 |
| Example 2 | | | | | |
| Coil 1 | 1100° | 1620° | 100 | Intermediate | 2/2 |
| Coil 2 | 1100° | 1620° | 200 | Intermediate | 1/1 |
| Coil 3 | 1100° | 1620° | 100 | Final | 1/1 |
| Coil 4 | 1100° | 1620° | 0 | | 1/2 |
| Coil 5 | 1100° | 1620° | 0 | | 1/1 |
| Coil 6 | 1100° | 1620° | 0 | | 1/1 |
| Coil 7 | 1100° | 1620° | 0 | | 1/1 |
| Coil 8 | 1100° | 1620° | 0 | | 1/1 |

TABLE II

| Sample and Coil | Strip Temp. at Exit: Preheat Furnace ° F | Strip Temp. at Exit: Radiant Tube Furnace ° F (25% $H_2$, 75% $N_2$ atmosphere) | Amount Sulfur Preheater (Grains/100$ft^3$) | Zone of Sulfur Addition | Adherence Test |
|---|---|---|---|---|---|
| Example 3 | | | | | |
| Coil 1 | 1030° | 1450° | 150 | Intermediate | 1/2 |
| Coil 2 | 1030° | 1450° | 150 | Final | 1/1 |
| Coil 3 | 1030° | 1450° | 150 | Final | 1/1 |
| Coil 4 | 1030° | 1450° | 150 | Final | 2/2 |
| Coil 5 | 1030° | 1450° | 0 | | 1/1 |
| Coil 6 | 1030° | 1450° | 0 | | 1/1 |
| Example 4 | | | | | |
| Coil 1 | 1075° | 1580° | 150 | Intermediate | 2/2 |
| Coil 2 | 1075° | 1580° | 150 | Final | 1/1 |
| Coil 3 | 1075° | 1580° | 150 | Final | 1/1 |
| Coil 4 | 1075° | 1580° | 0 | | 2/4 |

Auger spectra were obtained by means of an Auger Spectrometer, made by Physical Electronics, Inc., for the surface of aluminum-killed steel samples subjected to treatment in a direct fired preheater furnace containing about 100 grains of sulfur per 100 cubic feet of furnace atmosphere. These samples were taken from strip exiting the preheat furnace. It was found that both oxides and sulfur compounds were present in the surface scale. The oxide concentration was greatest at the surface and declined gradually with distance inwardly therefrom, whereas the sulfur content increased in a rather irregular manner inwardly from the surface to a maximum and then decreased.

A number of literature references deal with the oxidation and sulfidation of iron and suggest theoretical explanations of the mechanism of formation of iron sulfide and the concentration thereof at the scale-metal interface. Such theoretical considerations form no part of the present invention and hence are not discussed herein.

The relatively dark color film resulting from sulfur compounds has high heat absorptivity and hence is initially heated efficiently in the radiant tube section. Accordingly, the present invention provides the option of increasing strip speed and hence production, or operating at a lower furnace temperature in order to save fuel costs and reduce refractory wear. A combination of these two advantages could of course also be obtained.

From what has been said above with respect to processing aluminum-killed steel in accordance with the present invention containing more than a critical content of aluminum (as defined in the above Flinchum et al patent), it will be recognized that the process may be carried out to even greater advantage for low alloy steels containing up to about 3% aluminum, up to about 1% titanium, up to about 2% silicon, and/or up to about 5% chromium. Since alloy steels are relatively difficult to oxidize, the more easily formed sulfur and oxygen rich film makes it unnecessary to subject the material to oxidizing conditions as strong as those required in the Flinchum et al U.S. Pat. No. 3,925,579.

As indicated previously, the process of the invention is operative at levels ranging from about 5 to about 1600 grains of sulfur per 100 cubic feet of coke oven gas (about 0.007% to about 2.6% by volume hydrogen sulfide at standard temperature and pressure). A sulfur and oxygen rich film will be formed in a preheat furnace atmosphere containing up to 7% by volume excess combustibles, although perfect combustion conditions are preferred from the standpoint of fuel ecomony. As little as 10% hydrogen by volume in the radiant tube and cooling sections will reduce the sulfur and oxygen rich film in an anneal cycle wherein the maximum temperature is about 788° C., while at least about 20% hydrogen by volume is preferred if the maximum strip temperature is about 593° to about 650° C.

While the invention has been described in its preferred embodiments, it will be evident that modifications may be made without departing from the spirit and scope of the invention. Thus, in some Selas-type installations a holding section is provided between the radiant tube section and the cooling section, in which the strip may be held at some selected temperature (usually for a short period of time) after reaching a maximum temperature in the radiant tube furnace, in order to improve the formability or modify the mechanical properties of the steel strip. Preferably a reducing atmosphere containing at least 10% hydrogen by volume is maintained within such a control zone, although an inert atmosphere such as nitrogen could be provided. It is to be understood that the provision of such a control zone or holding step is within the scope of the present invention.

What we claim is:

1. A method of preparing the surfaces of aluminum-killed and low alloy steel strip and sheet material for fluxless hot dip coating with molten metal which comprises passing said material through a furnace heated by direct combustion therein of air with gaseous fuel containing sulfur compounds ranging from about 5 to about 1600 grains of sulfur per 100 cubic feet of fuel to produce an atmosphere of gaseous products of combustion including sulfur and from about 6% by volume free oxygen up to about 7% by volume excess combustibles in the form of carbon monoxide and hydrogen, in which atmosphere said material is heated to a maximum temperature sufficient to form a sulfur and oxygen rich film on said surfaces; passing said material into a further heating section wherein said material is brought to a maximum temperature of about 593° to about 927° C. in a reducing atmosphere containing at least about 10% hydrogen by volume; passing said material into a cooling section having a reducing atmosphere containing at least about 10% hydrogen by volume and the balance essentially nitrogen whereby to reduce said sulfur and oxygen rich film to provide a metallic iron surface wettable by said coating metal; and cooling said material approximately to the temperature of a molten bath of said coating metal.

2. The method claimed in claim 1, wherein said material is brought to a maximum temperature of about 427° to about 705° C. in said furnace heated by direct combustion, and wherein said material is brought to a maximum temperature of about 593° to about 788° C. in said further heating section.

3. The method claimed in claim 1, wherein said material is brought to a maximum temperature of about 593° to about 650° C. in said further heating section, and wherein the atmosphere in said further heating section contains at least about 20% hydrogen by volume.

4. The method claimed in claim 1, wherein said atmosphere of gaseous products of combustion in said furnace contains about 0% free oxygen and about 0% excess combustibles.

5. The method claimed in claim 1, wherein said coating metal is selected from the class consisting of aluminum, and alloys of aluminum.

6. The method claimed in claim 1, wherein said coating metal is selected from the class consisting of zinc, and alloys of zinc.

7. The method claimed in claim 1, wherein said coating metal is terne.

8. The method claimed in claim 1, wherein said fuel is coke oven gas.

9. The method claimed in claim 1, including the step of holding said material at a selected temperature, after reaching a maximum temperature in said further heating section, in a control zone having an atmosphere selected from the group consisting of a reducing atmosphere containing at least 10% by volume hydrogen, and nitrogen, and prior to said step of cooling said material.

10. The method claimed in claim 9, wherein a reducing atmosphere is maintained in said control zone.

* * * * *